United States Patent [19]

Alexis, Jr.

[11] Patent Number: 4,510,838

[45] Date of Patent: Apr. 16, 1985

[54] CYMBAL STAND WITH ROTATING HEAD

[75] Inventor: Raoul H. Alexis, Jr., Vallejo, Calif.

[73] Assignee: Keith Alexis, Davis, Calif.

[21] Appl. No.: 501,525

[22] Filed: Jun. 6, 1983

[51] Int. Cl.[3] ..... G10D 13/06; G10G 5/00

[52] U.S. Cl. ..... 84/422 R

[58] Field of Search ..... 84/421, 422

[56] References Cited

U.S. PATENT DOCUMENTS 4,200,024 4/1980 Watson ..... 84/421

4,274,322 6/1981 Cordes ..... 84/422 H

FOREIGN PATENT DOCUMENTS 565460 11/1944 United Kingdom ..... 84/422 H

*Primary Examiner*—Lawrence R. Franklin

*Attorney, Agent, or Firm*—Willis E. Higgins

[57] ABSTRACT

A support assembly (10) for a plurality of cymbals (34) has a stand (12) with a vertical shaft (14) rotatably mounted on the stand (12). A head (18) is fixed to the vertical shaft (14) and has arms (22), each including a cymbal clamp (24) at an end of the arm remote from the shaft (14). An electric motor (50) is connected by shaft (52), pulleys (54, 56) and belt (58) to rotate the shaft (14).

2 Claims, 4 Drawing Figures

CYMBAL STAND WITH ROTATING HEAD

BACKGROUND OF THE INVENTION

1. Field of the Invention

This invention relates to a stand that holds a plurality of cymbals in a unique manner. More particularly, it relates to such a stand that enables a performer to produce new sound combinations by presenting a plurality of cymbals in front of the performer in rapid succession.

2. Description of the Prior Art

There are a variety of cymbal stands known in the prior art. For example, my prior issued U.S. Pat. No. 4,216,696 describes a cymbal stand that allows a performer to achieve certain types of new effects by providing a beater and a damper for a cymbal mounted on the stand that are controlled by the performer's feet, leaving the performer's hands free to play the cymbal with a drumstick as well. Skilled percussionists strive to produce new effects with their instruments in order to advance their level of artistry and enhance their audience appeal. A wide variety of cymbal stand designs and related modifications to percussion instrument and percussion instrument support designs in addition to that disclosed in the above patent have been provided for that purpose. Examples of such designs are contained in U.S. Pat. Nos. 4,200,024; 3,893,363; 4,111,095; 4,177,709; 4,274,322; 4,048,895; 3,994,198; 4,248,129 and 4,315,453. However, all of these prior art designs either restrict the performer to playing a single instrument at a time or require that the performer's hands be moved to different positions for playing different instruments. Further modification of prior art cymbal stand designs is therefore needed to provide the performer with additional capability to produce novel percussion effects.

SUMMARY OF THE INVENTION

Accordingly, it is an object of this invention to provide a cymbal stand assembly which enables a performer to produce unique sound combinations from a plurality of cymbals.

It is another object of the invention to provide such a cymbal stand assembly which enables a performer to play an increased number of cymbals at a time.

It is still another object of the invention to provide a cymbal stand assembly which moves a plurality of cymbals to a playing location in rapid sequence.

These and related objects may be achieved through use of the novel cymbal support assembly herein disclosed. The assembly includes a stand and a head configured to hold at least one cymbal. The head is rotatably mounted on the stand. A motive means is connected to rotate the head. In one form of the invention, the head includes a plurality of arms extending radially from a vertical shaft centrally disposed on the stand. Each arm has an end remote from the shaft with a clamping means for a cymbal. The assembly also preferably includes a movable damper positioned to be proximate to each cymbal held by the head. There is a means on the stand connected to urge the movable dampers against each cymbal to dampen vibrations of each cymbal when desired.

The musical instrument support assembly of this invention allows a percussionist to rotate a number of cymbals mounted on the assembly past a given point in rapid succession. The percussionist may then strike each cymbal as it passes that point. The ability to play a number of cymbals at once in this manner allows the percussionist to achieve musical effects either not previously attainable or attainable only with great difficulty.

The attainment of the foregoing and related objects, advantages and features of the invention should be more readily apparent to those skilled in the art, after review of the following more detailed description of the invention, taken together with the drawings, in which:

DETAILED DESCRIPTION OF THE INVENTION

Figure 1:
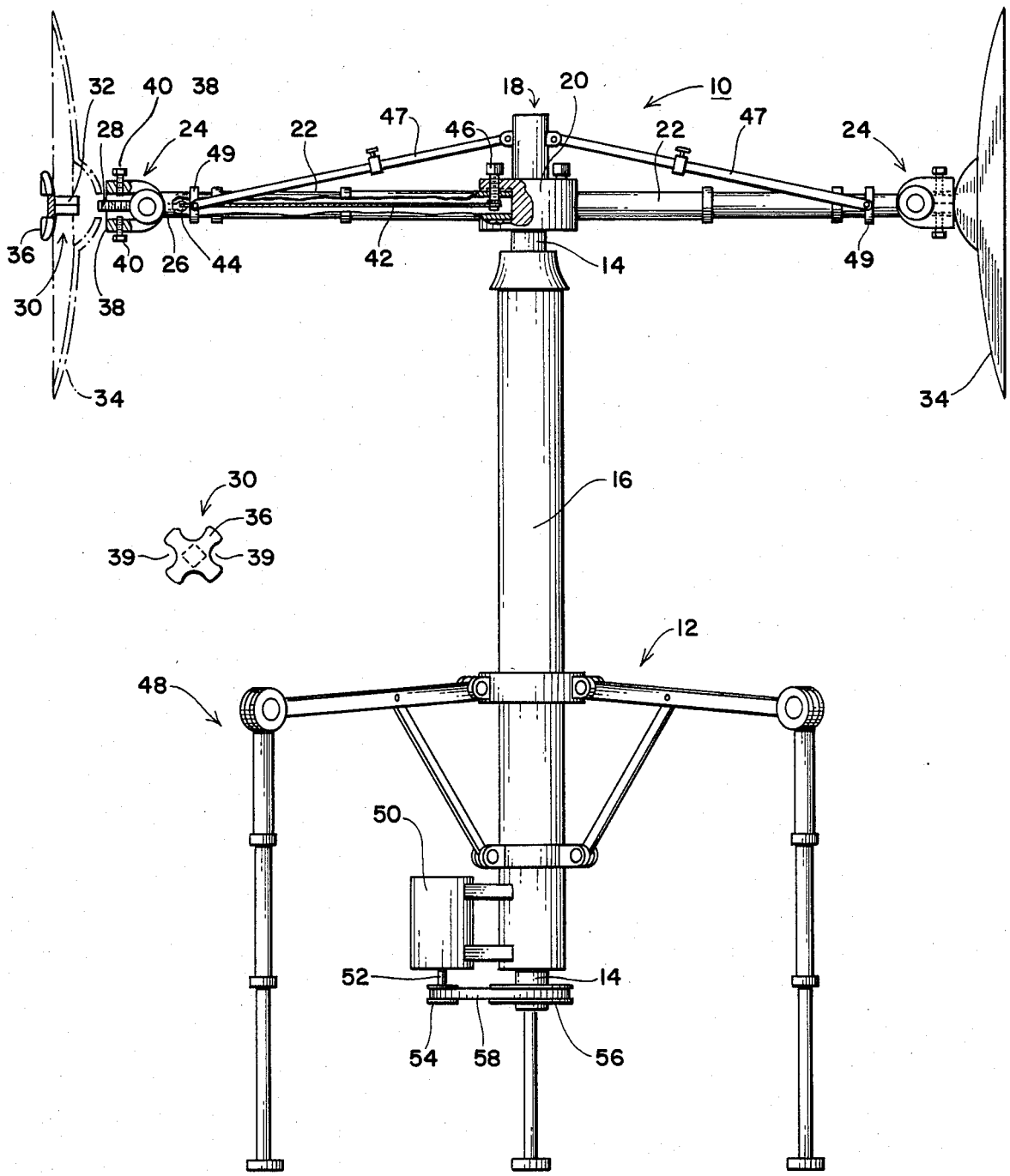
FIG. 1 is a front view of a cymbal support assembly in accordance with the invention with a partial cutaway to show interior detail.

Turning now to the drawings, more particularly to FIG. 1, there is shown a cymbal support assembly 10 in accordance with the invention. Stand 12 has a vertical shaft 14 mounted within tube 16 in suitable bearings (not shown) for rotation in either a clockwise or a counter clockwise direction. Head 18 is fixedly mounted to the upper end of the shaft 14 by means of hub 20. Each arm 22 has a cymbal clamp 24 fixedly attached to end 26 of the arm 22. The cymbal clamp 24 includes a threaded stud 28 projecting outward to receive nut 30. Nut 30 includes an interiorly threaded square cross section shaft portion 32, which fits through a central square aperture in cymbal 34. Head 36 of nut 30 clamps the cymbal 34 against projections 38 of cymbal clamp 24 when the nut 32 is screwed onto threaded stud 28. The head 36 is slotted at 39 to allow the nut 30 to be tightened securely against the cymbal 34. Screws 40 engage the sides of the shaft portion 32 when tightened by a drum key to prevent the nut 30 from screwing loose when the assembly is operating. Cable 42 within the arm 22 is attached to pin 44 of the cymbal clamp 24 and to screw 46 on hub 20. Screw 46 is tightened with a drum key after the telescoping arm 22 is extended in setting up the assembly 10, in order to hold the cymbal clamp 24 fixedly in place on the end 26 of the arm 22. Tie rods 47 are pivotally attached to the hub 20 and slidably attached to arms 22 by rings 49 to provide support for the arms 22. The tie rods 47 also telescope to promote portability of the stand 10. The rod 47 pivots on hub 20 and locks against pivoting to allow the rods 47 to support arms 22.

Stand 12 has a tripod 48 and a motor 50 mounted on the tube 16. Drive shaft 52 of the motor 50 is connected by pulleys 54 and 56 and belt 58 to rotate the shaft 14. In practice, the motor 50 is implemented as a motor that will drive the shaft 14 at a maximum of 60 rotations per minute, through use of a rate limiting device, if necessary.

In operation, the head 18 is rotated in either a clockwise or counterclockwise direction to pass cymbals 34 mounted on each arm 22 in front of a player successively. The player may then strike each cymbal 34 in succession with a drumstick or other suitable implement at the same location. With practice, the motions necessary to carry out the striking may be performed without conscious attention to each motion and adjusted in speed depending on the rotation rate employed.

Figure 2:
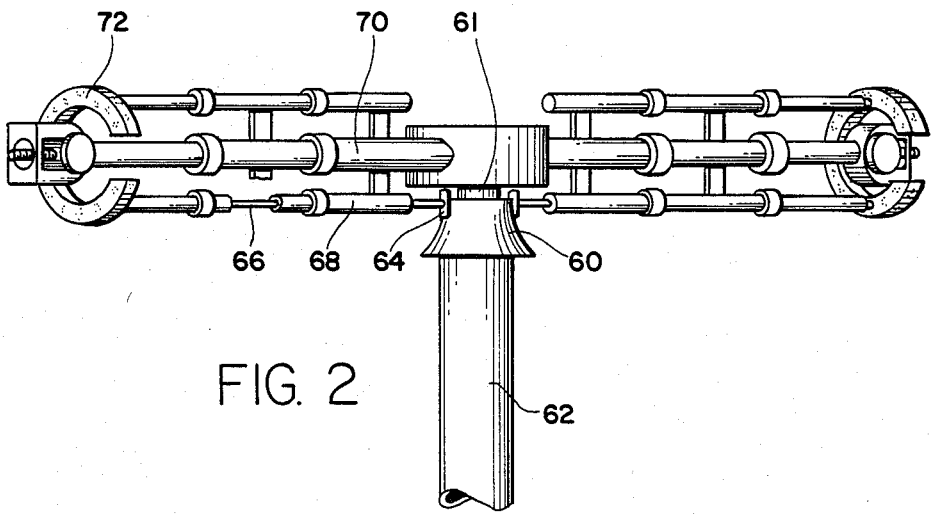
FIG. 2 is a front view of another embodiment of a cymbal support assembly in accordance with the invention.

FIG. 2 shows a portion of an alternative embodiment of the invention, in which a generally frustoconical camming surface 60 is provided at the top of cylinder 62. Cam follower 64 engages the camming surface 60 and moves radially outward when the camming surface 60 is moved upward relative to shaft 61. Cam follower 64 is connected by means of rod 66 within side arm 68, which is parallel to main arm 70. Rod 66 is connected to a felt or rubber collar 72. When the camming surface 60 is moved upward, the movement of cam follower 64 against the camming surface 60 causes the collar 72 to be moved against a cymbal 34 positioned in cymbal clamp 24 to function as a damper for the cymbal 34. Camming surface 60 is connected to a foot pedal or motor driven mechanism by a linkage (not shown) for moving the camming surface 60 upward to operate the damper 72. If desired, the shaft could be moved downward to move the cam follower 64 against the camming surface, but this would also require moving the drive motor for shaft 61 downward as well. Except as otherwise described, the construction and operation of the FIG. 2 embodiment of the invention is the same as the FIG. 1 embodiment.

Figure 3:
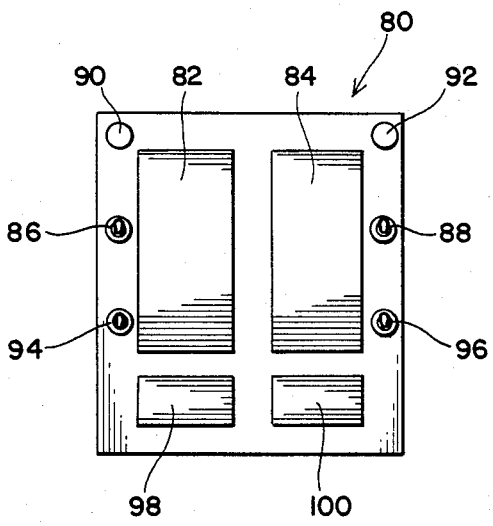
FIGS. 3 and 4 are front and side views of a foot pedal control for use with the cymbal support assemblies shown in FIGS. 1 and 2.
Figure 4:
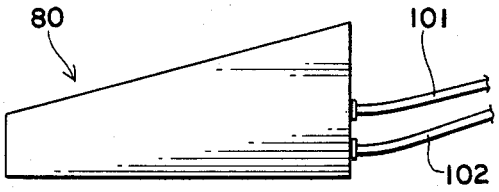

FIG. 3 shows details of a foot pedal control 80 for the embodiment of the invention shown in FIGS. 1 and 2. The control 80 is designed for controlling two of the assemblies 10, and includes foot pedals 82 and 84 for controlling the rate of rotation of heads 18 on the two assemblies 10. The rotation rate is increased by pressing down on the pedals 82 and 84 to a greater extent. There is a foot actuated ON-OFF toggle switch 86 and 88 provided for each foot pedal 82 and 84. Light emitting diode indicators 90 and 92 are illuminated when their corresponding toggle switches are turned on. Toggle switches 94 and 96 are provided for reversing the direction of rotation of the heads 18 of each assembly 10. Foot pedals 98 and 100 control operation of the damper mechanism in the FIG. 2 embodiment. Cables 100 and 102 connect the control 18 to the drive motor 50 and a drive for the camming surface 60 (if provided) of each assembly 10.

It should now be readily apparent to those skilled in the art that a novel cymbal support assembly capable of achieving the stated objects of the invention has been provided. By moving a plurality of cymbals to a playing location in rapid succession, the assembly of this invention allows a performer to play an increased number of cymbals at a time over prior art cymbal support assembly designs. As a result, the performer is able to produce unique sound combinations either not achievable or achievable only with great difficulty with prior art support assemblies much more readily.

It should further be apparent to those skilled in the art that various changes in form and details of the invention as shown and described may be made. It is intended that such changes be included within the spirit and scope of the claims appended hereto.

What is claimed is:

1. A cymbal support assembly, comprising a stand, a head configured to hold at least one cymbal, said head being rotatably mounted on said stand, and a motive means connected to rotate said head, said head being configured to hold a plurality of cymbals and including a plurality of arms extending radially from a vertical shaft centrally disposed on said stand, each arm being configured to hold one of the plurality of cymbals at an end remote from said shaft with a clamping means for the one cymbal, said motive means being operable to rotate the plurality of cymbals about said vertical shaft.

2. The cymbal support assembly of claim 1 in which said clamping means is configured to hold the one cymbal in a fixed, vertical position relative to each arm during rotation of the cymbals.

* * * * *